US010486451B1

(12) United States Patent
Drower et al.

(10) Patent No.: US 10,486,451 B1
(45) Date of Patent: Nov. 26, 2019

(54) PRINTABLE OVERLAMINATE FOR ATTACHMENT TO A SUBSTRATE

(71) Applicants: Herbert M. Drower, Franklin Park, IL (US); Mushtaq Anarwala, Franklin Park, IL (US); Timothy W. Albert, Dayton, OH (US)

(72) Inventors: Herbert M. Drower, Franklin Park, IL (US); Mushtaq Anarwala, Franklin Park, IL (US); Timothy W. Albert, Dayton, OH (US)

(73) Assignee: Transcendia, Inc., Franklin Park, IL (US)

( * ) Notice: Subject to any disclaimer, the term of this patent is extended or adjusted under 35 U.S.C. 154(b) by 0 days.

(21) Appl. No.: 14/466,064

(22) Filed: Aug. 22, 2014

Related U.S. Application Data

(60) Provisional application No. 61/870,071, filed on Aug. 26, 2013.

(51) Int. Cl.
*B41M 5/52* (2006.01)
*B41M 3/12* (2006.01)
*B41M 99/00* (2006.01)

(52) U.S. Cl.
CPC ..... *B41M 5/5263* (2013.01); *B41M 3/12* (2013.01); *B41M 2205/40* (2013.01)

(58) Field of Classification Search
CPC ..... B32B 27/08; B32B 27/32; B32B 27/36; B32B 37/12; B32B 2250/03; B32B 2260/046; B32B 7/12; B32B 2307/7246; B32B 2307/7265; B32B 2471/00; B32B 2425/00; B32B 2451/00; B32B 2260/028; B32B 2307/402; B32B 2307/4023; B32B 2307/4026; B32B 2038/166; B32B 21/06; C09J 2475/00; C09J 2457/001–008; Y10T 156/10; Y10T 428/24802; Y10T 428/31786; Y10T 428/31993; Y10T 428/24934; Y10T 428/2998; Y10T 428/31982; Y10T 156/1092; B41M 5/00; B41M 5/0041; B41M 5/0047; B41M 5/0052; B41M 5/0058; B41M 5/0064; B41M 5/007; B41M 5/0076; B41M 5/50; B41M 5/502; B41M 5/504; B41M 5/506;
(Continued)

(56) References Cited

U.S. PATENT DOCUMENTS 2,748,042 A * 5/1956 Borgese ..... 428/215
5,066,047 A * 11/1991 Mailloux et al. ..... 283/86
(Continued)

FOREIGN PATENT DOCUMENTS

DE 3939864 A1 * 6/1991 ..... B42D 15/10
JP 2009300560 A * 12/2009 ..... G06F 3/10

*Primary Examiner* — Maria V Ewald
*Assistant Examiner* — Ethan Weydemeyer
(74) *Attorney, Agent, or Firm* — Cook Alex Ltd.

(57) ABSTRACT

A printable overlaminate for attachment to a substrate permits application of decorative and/or informative printing on materials that normally are not receptive to ordinary inks. The overlaminate has a release liner releasably attached to a protective layer. On the protective layer is an ink acceptable adhesive, the exposed surface of which receives ordinary ink. After printing the ink acceptable layer is transferred to a substrate through the use of heat and pressure. Then the release liner is removed, leaving the ink visible through the protective layer.

33 Claims, 2 Drawing Sheets

(58) Field of Classification Search
CPC ..... B41M 5/508; B41M 5/52; B41M 5/5209; B41M 5/5218; B41M 5/5227; B41M 5/5236; B41M 5/5245; B41M 5/5254; B41M 5/5263; B41M 5/5272; B41M 5/5281; B41M 5/529; B41M 7/00; B41M 7/0018; B41M 7/0027; B41M 7/0036; B41M 7/0045; B41M 7/0054; B41M 99/00
USPC ..... 101/494; 347/101, 105–106; 427/146–153; 428/32.1–32.38
See application file for complete search history.

(56) References Cited

U.S. PATENT DOCUMENTS

| | | | | |
|---|---|---|---|---|
| 5,271,990 | A * | 12/1993 | Kronzer et al. | 428/195.1 |
| 5,837,341 | A * | 11/1998 | Johnstone | 428/41.3 |
| 6,520,235 | B1 * | 2/2003 | Pasti | B29C 43/24 156/501 |
| 2003/0148692 | A1 * | 8/2003 | Chikamori | B32B 5/24 442/374 |
| 2004/0055698 | A1 * | 3/2004 | Tran | B32B 38/0008 156/272.6 |
| 2005/0100689 | A1 * | 5/2005 | He | B32B 27/00 428/32.79 |
| 2007/0014959 | A1 * | 1/2007 | Massullo | 428/40.1 |
| 2008/0102268 | A1 * | 5/2008 | Higasa et al. | 428/335 |
| 2011/0266788 | A1 * | 11/2011 | Geuens | 283/109 |
| 2012/0071808 | A1 * | 3/2012 | Sato et al. | 602/54 |

* cited by examiner

PRINTABLE OVERLAMINATE FOR ATTACHMENT TO A SUBSTRATE

CROSS-REFERENCE TO RELATED APPLICATION

This application claims the benefit of U.S. Application Ser. No. 61/870,071, filed Aug. 26, 2013, the disclosure of which is incorporated herein by reference.

FIELD OF THE DISCLOSURE

The present disclosure is directed to printable laminates.

BACKGROUND

An ongoing problem in the graphic arts field is printing on plastics and plastic-laminated substrates. Credit cards, ID cards and the like are example of products having plastic substrates that require printing on one or both surfaces. Many ordinary liquid inks are designed to work well with paper because the ink can soak into the porous fiber network therein. However, because most plastics do not absorb liquid ink the way paper does, ordinary ink typically does not produce acceptable results on plastic. While the ink will dry, it tends to remain on the surface of plastic substrates where it is not durable. The ink is easily worn off or it tends to smudge or smear. Attempts have been made to address this problem by altering either the ink or the plastic substrate to make them more compatible, but doing so raises the cost of the materials and may adversely affect their basic functions as well. For example, adding an adhesive to the ink may assist in making it bond to the plastic. Or additives, such as talc, can be incorporated in the plastic to enhance its ability to absorb ordinary ink. Additionally, there are plastics that will absorb ink or other aqueous materials, but they also thus absorb moisture from any subsequent exposure source, particularly after printing, and they can thereby swell to twenty to thirty times their normal size. While these approaches offer some improvement over the use of ordinary ink on plastic, the need still exists for alternative solutions.

SUMMARY

In one aspect, the present disclosure concerns the use of an ink accepting adhesive (IAA) which can be printed on and then transferred to a wide variety of substrates. The IAA layer is initially connected to a protective layer which in turn is connected to a release liner. The protective layer may be extruded on the release liner or applied in sheets that are bonded to the release liner. The release liner can be either paper or plastic. The protective layer is transparent and resistant to abrasion, heat and many chemicals. Once the exposed surface of the IAA layer is printed, it is bonded to a substrate, typically by means of heat and pressure. Then the release liner is removed from the protective layer, leaving the protective layer overlying the printed IAA layer, which is bonded to the receiving substrate.

An alternate embodiment of the disclosure is preferred for elevated humidity environments. The moisture-warding version adds to the basic embodiment described above a moisture-warding layer between the IAA and protective layers and a second moisture-warding layer on the substrate. The moisture-warding layers act in such a fashion as to shield the construction from distortion by further significant absorption and expansion of the IAA layer with water. Thus, when the printed IAA layer is transferred to the substrate, the IAA layer will be bounded on both sides by the moisture-warding layers. Alternately, the IAA layer may be bounded on only one side by a moisture-warding layer.

A further alternate embodiment enables substitution of the protective layer with a polyester and polyethylene copolymer laminate film. Still another alternate embodiment includes the IAA layer and the protective layer without a release liner.

DETAILED DESCRIPTION OF THE EMBODIMENTS

The present disclosure is directed to a thin, flexible, clear plastic sheet which can be printed and then laminated or bonded to rigid or flexible substrates to provide a decorative and/or information-bearing surface. The printed surface is protected by a protective layer. The surface which receives the ink is a heat-activated, thermal adhesive which can bond to many types of substrates. The printable adhesive is absorbent so the inks do not impede the ability of this surface to bond.

Figure 1:
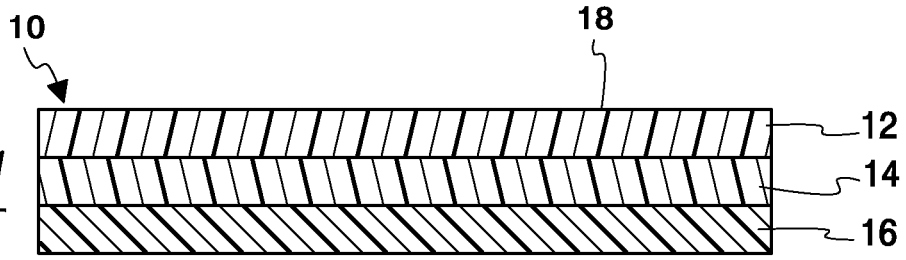
FIG. 1 is a diagrammatic cross-section through a laminate according to a first embodiment of the invention.

FIG. 1 illustrates a first embodiment of the laminate of the present invention. The laminate, shown generally at 10, includes an ink acceptable adhesive (IAA) layer 12 The IAA layer 12 is formed on a protective layer 14, which is releasably bonded to a release liner 16. The protective layer 14 could be extruded on to the release liner 16 or it could be a free-standing film that is laminated onto the release liner. By way of example only and not by limitation, the combined thickness of the IAA layer 12 and the protective layer 14 is about two to twelve mils, with the individual layers each comprising about half of that total thickness. It will be understood that the drawings are schematic in nature and are not drawn to scale. Thus, the thicknesses of the layers and the ratios of the thicknesses could be other than as shown and described and the invention is not limited to the thicknesses and ratios given. The thickness of the release liner 16 is not critical to the application. The release liner is of well-known construction and could be paper or plastic with or without a coating.

In FIG. 1, components 12 and 14 of laminate 10 form a clear, multi-layer sheet that can be used as a decorative outer layer which can be printed on and then laminated (typically using heat and pressure) to rigid or flexible substrates. A wide variety of substrates could be used, including: rigid plastics such as polyester, vinyl, polyolefin, etc.; rigid foam plastics made of various plastics such as PVC or polystyrene; medium density fiberboard; plywood; steel and other metals; and flexible substrates such as woven and non-woven cloth or other fibrous materials. Also, while the IAA layer 12 is usually activated by heat and pressure, it can also be laminated to the substrates with other types of adhesives such as epoxy, PVA, etc.

The IAA layer 12 accepts most any kind of ink including digital solvent inks, digital water based inks, digital UV, lithographic inks, flexographic inks and the like. These inks will be absorbed into the IAA layer 12. The exposed, printed surface 18 of the IAA layer 12 will then be able to act as an adhesive allowing the layer 12 to bond to the many types of rigid and flexible substrates identified above. After bonding of the IAA layer 12 to the substrate, the release liner 16 is removed, thereby exposing the protective layer 14. The protective layer 14 acts to protect the IAA layer 12 from wear, abrasion, various chemicals and heat.

The IAA layer 12 is made of an aliphatic, hydrophilic polyether-based resin, such as Estane® ALR G500, available from Lubrizol Advanced Materials, Inc. of Cleveland, Ohio. This material has a durometer (Shore Hardness) of about 60D (dry), a specific gravity of about 1.16, ultimate tensile strength of about 1000 psi (dry) and about 250 psi (wet), and ultimate elongation % of about 100 (dry) to about 200 (wet). It will be understood that this is an example of a suitable material for the IAA layer and that the invention is not limited to this specific example.

The protective layer 14 is an aliphatic, polyether-based thermoplastic polyurethane resin, such as that sold by Lubrizol Advanced Materials, Inc. of Cleveland Ohio, under its trademark Estane® ALR CL57D-V. This material has a durometer (Shore Hardness) of about 57D, a specific gravity of about 1.15, ultimate tensile strength of about 9,350 psi, and ultimate elongation % of about 370, a 100% modulus of about 2,185 psi and a 200% modulus of about 3,765 psi, a flexural modulus of about 9,200 psi and a melt index (g/10 min @ 175° C., 2160 g load) of about 3.2. Again, this is an example of a suitable material for the protective layer and the invention is not limited to this specific example.

A normal adhesive layer would experience serious degradation of its adhesive function if there is more than about 25% ink coverage. That does not happen with the present invention. The present invention allows printing to appear on a substrate without using specialized ink, specialized adhesives to retain the ink, specialized substrates or separate processing steps.

Figure 2:
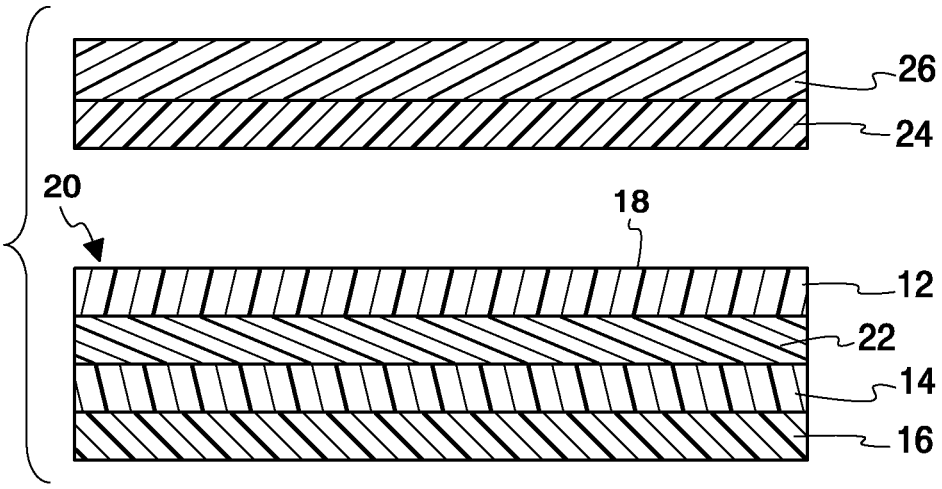
FIG. 2 is a diagrammatic, exploded cross-section through a laminate according to a second embodiment of the invention.

Some environments that involve high humidity may require an additional layer touching one or both sides of the IAA layer. One such an alternate embodiment is shown generally at 20 in FIG. 2, where components 12, 22, and 14 form a clear, multi-layer sheet. In this embodiment a first moisture-warding layer is shown at 22 between the IAA layer 12 and the protective layer 14. A second moisture-warding layer 24 is also supplied. In this case the second moisture-warding layer 24 is formed on the substrate 26, which is another stable, protective film. Alternately, the second moisture-warding layer 24 could be applied to the top of the IAA layer 12 after printing on it. A further alternative would be to place a moisture-warding layer on only one side of the IAA layer, either above or below the IAA layer. It will be understood that in the embodiment of FIG. 2, the user will print on the initially exposed printable surface 18 of the IAA layer 12 and then bond the laminate 20 to the second moisture-warding layer 24 on the protective substrate 26. Finally, the release liner 16 is removed, allowing the printing on IAA layer 12 to be visible through the protective layer 14, the first moisture-warding layer 22, and IAA layer 12.

The combination of the IAA layer 12, the protective layer 14 and the first moisture-warding layer 22 can have a thickness of about ten to thirty mils. The moisture-warding layer is a polyester-based, thermoplastic polyurethane resin. A suitable thermoplastic extrusion grade of this resin is sold by Lubrizol Luxembourg S.A.R.L. of Luxembourg under its trademark Pearlbond® 180. This material has the following properties: density @ 20° C. is about 1.19 g/cm$^3$; Shore hardness of about 50D; melt viscosity (160° C./2.16 Kg) of about 620 Pa·s; softening range of about 60-70° C. and a melting range of about 65-71° C. A suitable aqueous coating grade of the moisture-warding layer is Daubond® 6477M3, available from Daubert Chemical Company, Inc. of Chicago, Ill. Again, these are examples of suitable materials but the invention is not limited to these specific examples.

Figure 3:
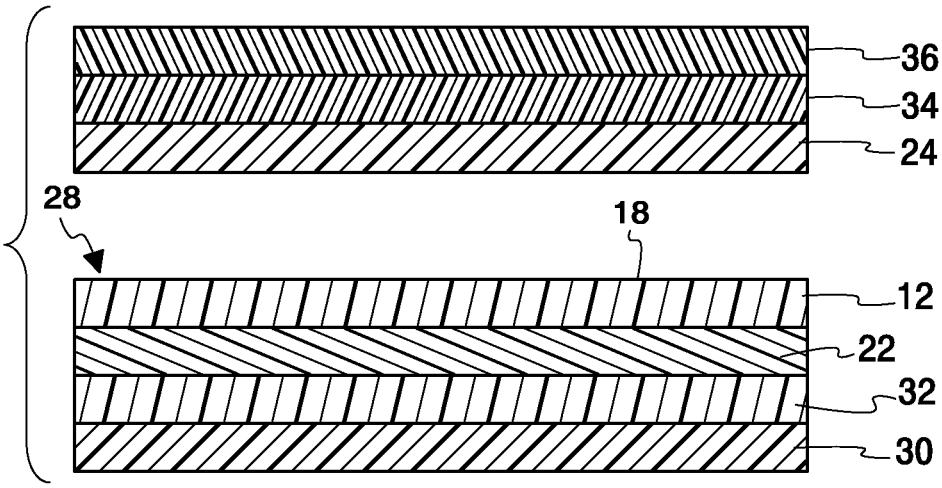
FIG. 3 is a diagrammatic, exploded cross-section through a laminate according to a third embodiment of the invention.

The moisture-warding layers also provide a path to a second alternate embodiment wherein less expensive alternatives can be substituted for the protective layer 14. This laminate is shown generally at 28 in FIG. 3. This embodiment has a first polyester layer 30 extrusion coated with a first polyethylene layer 32. The first moisture-warding layer 22 is bonded to the first polyethylene copolymer layer 32. The IAA layer 12 is bonded to the moisture-warding layer 22, as in the embodiment of FIG. 2. Opposite this structure is a second moisture-warding layer 24 as in the previous embodiment—but here instead of the second moisture-warding layer 24 being attached to a single-layer protective substrate, it is attached to a combined layer including a second polyethylene copolymer layer 34 and a second polyester layer 36. This construction eliminates the single protective layer by substituting less costly materials.

Figure 4:
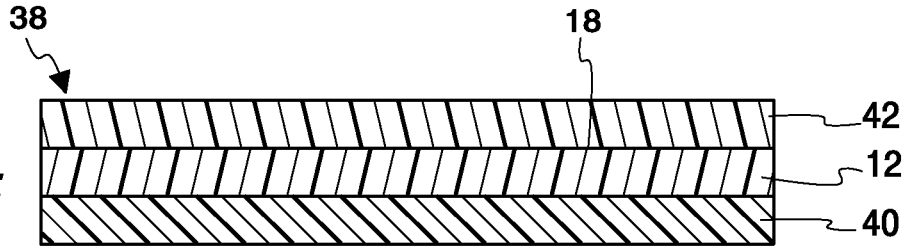
FIG. 4 is a diagrammatic cross-section through a laminate according to a fourth embodiment of the invention.
Figure 5:
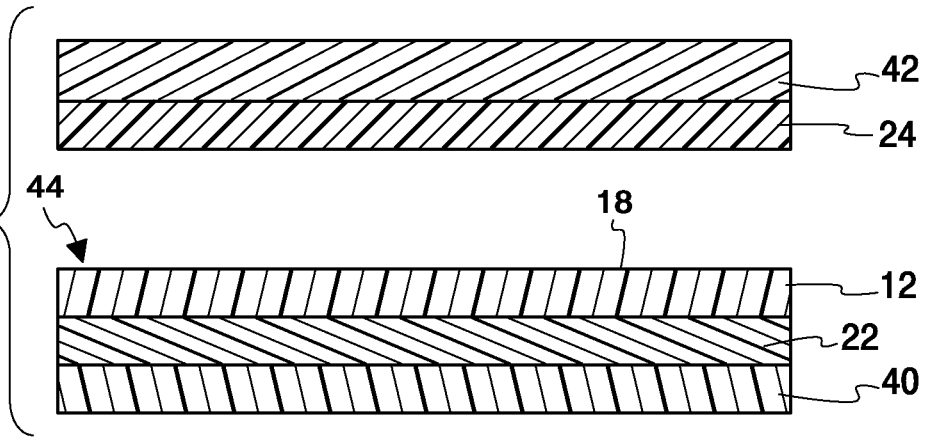
FIG. 5 is a diagrammatic cross-section through a laminate according to a fifth embodiment of the invention.

FIG. 4 illustrates a further alternate embodiment generally at 38. In this embodiment the IAA layer 12 is extruded directly onto a rigid calendered polyvinyl chloride 40. We can print on the exposed, printed surface 18 of this material by the methods previously mentioned. We can then over laminate the image with an uncoated, clear, calendered polyvinyl chloride 42. The product can then be laminated using platen press or roll laminating procedures. It is also pointed out that the IAA layer 12 could be coated onto the polyvinyl chloride. For additional strength and moisture resistance the embodiment shown at 44 in FIG. 5 can be beneficial. Here we may put one of the moisture-warding layers 22 and/or 24 mentioned above on one or both layers 40, 42 of the polyvinyl chloride before we lay down the IAA and do the imaging. The clear over laminate may use other plastics such as polyester/polyolefin, TPU (thermoplastic polyurethane and other materials). The polyvinyl chloride substrate upon which we lay down the IAA can be replaced by other plastics such as oriented polyester, high impact styrene, polypropylene, etc.

Figure 6:
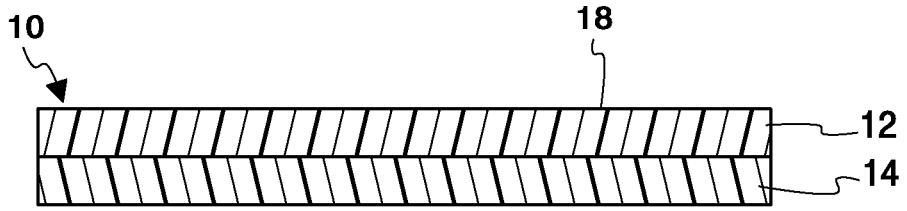
FIG. 6 is a diagrammatic cross-section through a laminate according to a sixth embodiment of the invention.

FIG. 6 illustrates a further variation at 46. It has been found that some applications will not require the use of a release liner. Thus, laminate 46 is the same as the first embodiment 10 except the release liner is not present. Only the IAA layer 12 and protective layer 14 are present in this embodiment. This could be one solid sheet and one coating or extrusion. Or it could be a co-extrusion or tandem extrusion. That is, you could extrude the protective layer and then the IAA layer could be extruded right onto the protective layer.

It will be understood that both the IAA layer and the protective layer could be formed using one of an extrusion, casting or coating process. The protective layer could be extruded, cast or coated onto the release liner, in instances where a release liner is used. A coating is essentially a liquid coating such as might be applied by rotogravure coating. Many, but not all, liquid coatings involve a carrier, such as water or a solvent, that evaporates after application. An extrusion is a molten solid that does not include anything that evaporates; it is 100% solids (when not melted). The advantage of a coating is it can result in a thinner layer. The total thickness of the IAA layer and protective layer could be as little as 0.0002 inches (0.2 mil).

In addition to the protective layer material mentioned above, a suitable protective layer has been found to be heat transfer paper sold by Formel Industries, Inc. of Franklin Park, Ill. This product is a durable clear varnish coating applied to a release liner paper. The IAA layer can be extrusion coated or liquid coated on top of the Formel heat transfer paper. Then we can digitally print an image and then bond this product by means of heat and pressure to many types of substrates. The varnish coat provides excellent protection to the printed IAA layer. While the Formel product works well, other varnish type coatings with other attributes could also be used.

One of the advantages of the present disclosure is the single IAA layer is functioning both as a liquid absorbable layer and a thermal adhesive in one. Both features present, without detriment to the effect of either.

It should be understood that various changes and modifications to the presently preferred embodiments described herein will be apparent to those skilled in the art. Such changes and modification can be made without departing from the spirit and scope of the invention disclosed herein. For example, thermoplastic adhesive grades other than those polyethylene-based could be used in the embodiment of FIG. 3.

The invention claimed is:

1. A printable overlaminate for attachment to a substrate, comprising a protective layer that is resistant to abrasion and heat and an ink acceptable adhesive layer having first and second surfaces with the first surface connected to the protective layer, the second surface of the ink acceptable adhesive layer being exposed for receiving ink thereon and defining a surface area, the ink acceptable adhesive layer comprising a composition being absorbent such that a) inks applied to at least about 25% of said surface area do not impede the ability of the exposed surface of the ink acceptable adhesive layer to bond to said substrate and b) in the whole of the ink acceptable adhesive layer itself is bondable to said substrate, including in the areas that have received ink, and no bonding of the ink to the substrate is required.

2. The structure of claim 1 further comprising a release liner releasably attached to the protective layer.

3. The structure of claim 1 wherein the ink acceptable adhesive layer is an aliphatic, hydrophilic polyether-based resin.

4. The structure of claim 1 wherein the ink acceptable adhesive layer has a dry Shore hardness durometer of about 55D to about 65D.

5. The structure of claim 4 wherein the ink acceptable adhesive layer has a dry Shore hardness durometer of about 58D to about 62D.

6. The structure of claim 1 wherein the protective layer is an aliphatic, polyether-based thermoplastic polyurethane resin.

7. The structure of claim 1 wherein the protective layer has a Shore hardness durometer of about 52D to about 62D.

8. The structure of claim 7 wherein the protective layer has a Shore hardness durometer of about 55D to about 59D.

9. The structure of claim 1 wherein the ink acceptable adhesive layer and the protective layer have a Shore hardness durometer within about five points of each other on the Shore D scale.

10. The structure of claim 1 wherein the combined thickness of the ink acceptable adhesive layer and the protective layer is about 0.2 to 12 mils.

11. The structure of claim 10 wherein the combined thickness of the ink acceptable adhesive layer and the protective layer is about 2 to 12 mils.

12. The structure of claim 1 wherein the protective layer is made of heat transfer paper.

13. The structure of claim 1 wherein the ink acceptable adhesive layer is one of a coating, casting or extrusion formed on the protective layer.

14. The structure of claim 1 wherein the protective layer is one of a coating, casting or extrusion.

15. The structure of claim 1 wherein the ink acceptable adhesive layer is connected to the protective layer by a moisture-warding layer which intervenes between the ink acceptable adhesive layer and the protective layer.

16. The structure of claim 15 wherein the protective layer comprises a laminate having a first polyester layer and a first polyethylene layer.

17. The structure of claim 16 wherein the first polyethylene layer is extrusion coated on the first polyester layer.

18. The structure of claim 15 further comprising a second moisture-warding layer connected to the ink acceptable adhesive layer.

19. The structure of claim 18 wherein the second moisture-warding layer is connected to a substrate.

20. The structure of claim 1 wherein the protective layer comprises a laminate having a first polyester layer and a first polyethylene layer and wherein the substrate comprises a laminate having a second polyester layer and a second polyethylene layer.

21. A printable overlaminate for attachment to a substrate, comprising a protective layer that is resistant to abrasion and heat and an aliphatic, hydrophilic polyether-based resin layer connected on one side thereof to the protective layer and on the other side thereof presenting an exposed surface for receiving ink thereon and defining a surface area, the resin layer comprising a composition being absorbent such that a) inks applied to at least about 25% of said surface area do not impede the ability of the exposed surface of the resin layer to bond to said substrate and b) in the whole of the second surface the ink acceptable adhesive layer itself is bondable to said substrate, including in the areas that have received ink, and no bonding of the ink to the substrate is required.

22. The structure of claim 21 further comprising a release liner releasably attached to the protective layer.

23. The structure of claim 21 wherein the resin layer is connected to the protective layer by a moisture-warding layer which intervenes between the resin layer and the protective layer.

24. The structure of claim 23 wherein the protective layer comprises a laminate having a first polyester layer and a first polyethylene layer.

25. The structure of claim 24 wherein the first polyethylene layer is extrusion coated on the first polyester layer.

26. The structure of claim 23 further comprising a second moisture-warding layer connected to the resin layer.

27. The structure of claim 26 wherein the second moisture-warding layer is connected to a substrate.

28. The structure of claim 21 wherein the protective layer comprises a laminate having a first polyester layer and a first polyethylene layer and wherein the substrate comprises a laminate having a second polyester layer and a second polyethylene layer.

29. A printable overlaminate for attachment to a substrate, comprising a first calendered polyvinyl chloride layer that is resistant to abrasion and heat and an ink acceptable adhesive layer connected to the first calendered polyvinyl chloride layer, the ink acceptable adhesive layer having first and second surfaces with the first surface connected to the first calendered polyvinyl chloride layer and the second surface being exposed for receiving ink thereon and defining a surface area, the ink acceptable adhesive layer comprising a composition being absorbent such that a) inks applied to at least about 25% of said surface area do not impede the ability of the exposed surface of the ink acceptable adhesive layer to bond to said substrate and b) in the whale of the second surface the ink acceptable adhesive layer itself is bondable to said substrate, including in the areas that have received ink, and no bonding of the ink to the substrate is required.

30. The structure of claim 29 further comprising a second calendered polyvinyl chloride layer connected to the ink acceptable adhesive layer on the side opposite the first calendered polyvinyl chloride layer.

31. The structure of claim 29 wherein the ink acceptable adhesive layer is connected to the first calendered polyvinyl chloride layer by a moisture-warding layer which intervenes between the ink acceptable adhesive layer and the first calendered polyvinyl chloride layer.

32. The structure of claim 31 further comprising a second moisture-warding layer connected to the ink acceptable adhesive layer.

33. The structure of claim 32 further comprising a second calendered polyvinyl chloride layer, the second moisture-warding layer being connected to the second calendered polyvinyl chloride layer.

* * * * *